US006640374B1

(12) United States Patent
Courtney et al.

(10) Patent No.: US 6,640,374 B1
(45) Date of Patent: Nov. 4, 2003

(54) CURB BRUSH IS AN IMPLEMENT FOR DISPLACING DEBRIS FROM THE TOP AND BOTTOM OF ROUNDED CURBS

(75) Inventors: Michael Harold Courtney, Noblesville, IN (US); Cass Ryan Courtney, Noblesville, IN (US)

(73) Assignees: Michael H Courtney; Cass R Courtney

( * ) Notice: Subject to any disclaimer, the term of this patent is extended or adjusted under 35 U.S.C. 154(b) by 36 days.

(21) Appl. No.: 09/920,474

(22) Filed: Aug. 1, 2001

(51) Int. Cl.[7] ..... E01H 1/02
(52) U.S. Cl. ..... 15/78; 15/87; 15/93.1
(58) Field of Search ..... 15/4, 78, 87, 93.3, 15/340.3, 340.4, 93.1

(56) References Cited

U.S. PATENT DOCUMENTS 873,569 A * 12/1907 Malmquist
4,393,537 A * 7/1983 Reprogle et al.
5,742,967 A * 4/1998 Giessler

* cited by examiner

*Primary Examiner*—Terrence R. Till

(57) ABSTRACT

Curb Brush is an implement for displacing debris from the top and bottom of rounded curbs with a steel scraper cut to the shape of the curb to remove large debris; a gutter broom mounted behind the steel scraper spinning counter clockwise to displace debris from the top of the curb onto the edge of the street; a second gutter broom mounted behind the first and offset from the curb to displace debris from the bottom of the curb onto the edge of the street. A preferred embodiment includes a water tank with two water nozzles mounted in front of each gutter broom to lower amount of airborne dust. A safe embodiment includes rubber shields mounted at front and along side of implement and a carpenter mesh shield above gutter brooms to stop any loose or dangerous debris. A preferred embodiment includes wherein said steel scraper, gutter brooms, and universal backing plate are welded to steel tubing frame for use with a skid steer.

12 Claims, 5 Drawing Sheets

CURB BRUSH IS AN IMPLEMENT FOR DISPLACING DEBRIS FROM THE TOP AND BOTTOM OF ROUNDED CURBS

BACKGROUND OF THE INVENTION

This invention relates generally to the field of street sweeping and construction cleanup, and more particularly the curb brush is an implement for improved displacement of debris from the top and bottom of round curbs adding safety and effectiveness over past inventions. The invention combines the qualities and benefits of previous technology and eliminates the shortcomings of these prior technologies.

In residential sites, especially during construction, large amounts of debris collect on the streets. This debris must be removed for aesthetic and practical purposes. Methods typically involve machines or attachments to skid steers. Both of these incorporate similar methods to displace debris or clean the streets. Along with the necessity to clean the streets, large amounts of debris collect on the curbs. A need exists for a more effective and safe way to clear debris from rounded curbs.

There are many different past machines used to clean streets. Attachments to skid steers are often used. One attachment acts as a large shovel to scrape debris from the street. Another attachment often used combines the scraper with a series of brushes in front of the machine. The brushes spin and displace dirt into the scraper. Yet another attachment is made to specifically clean gutters. This attachment spins counter clockwise to displace debris to the center of the street. All of these parts and features are combined on large machines specifically made to clean streets.

There are many deficiencies in prior technology. The scraper only removes large amounts of debris. The scraper and the sweepster attachment only clean flat areas. They are unable to clean rounded curbs. Furthermore, they do not protect the operator, passerby nor the environment from flying debris. In the operation of the scraper and sweepster air born debris, specifically in the form of dust, are not maintained. The gutter broom cleans only a small area. Therefore, it only cleans the top or bottom of rounded curbs, but not both. Furthermore, the gutter broom is not able to displace large debris effectively and provides no safety to the operator, passerby nor the environment from flying debris. Nor does the gutter broom control airborne debris, specifically in the form of dust. Machines that combine all of these do not allow for easy repair or easy transport especially through construction sites. The shortcomings leave a necessity for an implement that can clean rounded curbs effectively while allowing safe, effective and easy use, transport, specifically through construction sites, and repair.

SUMMARY OF THE INVENTION

The primary object of the invention is to allow for better displacement of debris from rounded curbs utilizing two gutter brooms and a steel scraper. In residential sites, rounded curbs often collect a large amount of debris. Previous technologies such as bucket attachments, sweepster attachments and gutter brooms cannot adequately clean debris off of rounded curbs. In the first object, better displacement of debris from rounded curbs relies upon placement of the gutter brooms and the steel scraper in construction of the curb brush.

Another object of the invention is to secure two gutter brooms and steel scraper to a universal backing plate for function on a skid steer. The prior technologies attached easily to skid steers. An object of this invention is to operate safely and efficiently on a skid steer, thus making the curb brush easy to operate within construction sites.

Another object of the invention is to allow for replacement of any working parts including gutter brooms, steel scraper, rubber shields and carpenter mesh guard. The implement is easily adjusted and fixed if any problems occur. Unlike prior technologies that were hard to repair and access, as parts of the curb brush wear, they can be easily fixed.

A further object of the invention is to reduce dust by use of water spray nozzles. Early and current technologies do not allow for airborne dust. Loose debris is controlled easier by the addition of water. The spray nozzles deliver quick and effective solutions to airborne dust particles.

Yet another object of the invention is to contain dangerous debris with rubber shields and carpenter's mesh shield. Gutter brooms rotate quickly and can send debris moving dangerously fast. The rubber shields protect the surrounding environment, the implement and the operator from any flying debris. The carpenter's mesh is an added safety precaution to contain dangerous debris acting in the same manner as the rubber shields. The mesh still allows the operator full visibility, but in a much more safe position. Previous technologies failed to contain all of the debris and threaten the safety of skid steer, passerby, operator and environment. Within a construction site, the containment of the debris is essential.

Still yet another object of the invention is to allow for safe loading, transport and unloading with proper guards and locks. An important part of this invention is the security. As well as protecting the operator while in operation, the implement is secure and debris is contained at all times.

Other objects and advantages of the present invention will become apparent from the following descriptions, take in connection with the accompanying drawings, wherein, by way of illustration and example, an embodiment of the present invention is disclosed.

In accordance with a preferred cleaning technique, a curb brush is an implement for displacing debris from the top and bottom of rounded curbs comprising: a steel scraper cut to the shape of the curb to remove large debris; a gutter broom mounted behind the steel scraper spinning counter clockwise to displace debris from the top of the curb onto the edge of the street; a second gutter broom mounted behind the first and offset from the curb to displace debris from the bottom of the curb onto the edge of the street; a water tank with two water nozzles mounted in front of each gutter broom to lower amount of airborne dust; and rubber shields mounted at front and along side of the implement and a carpenter mesh shield above the gutter brooms to stop any loose or dangerous debris. In a preferred embodiment, the implement includes safety guards to provide safe loading, transport and unloading. Other safety features in a preferred embodiment allow for easier and safe operation.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
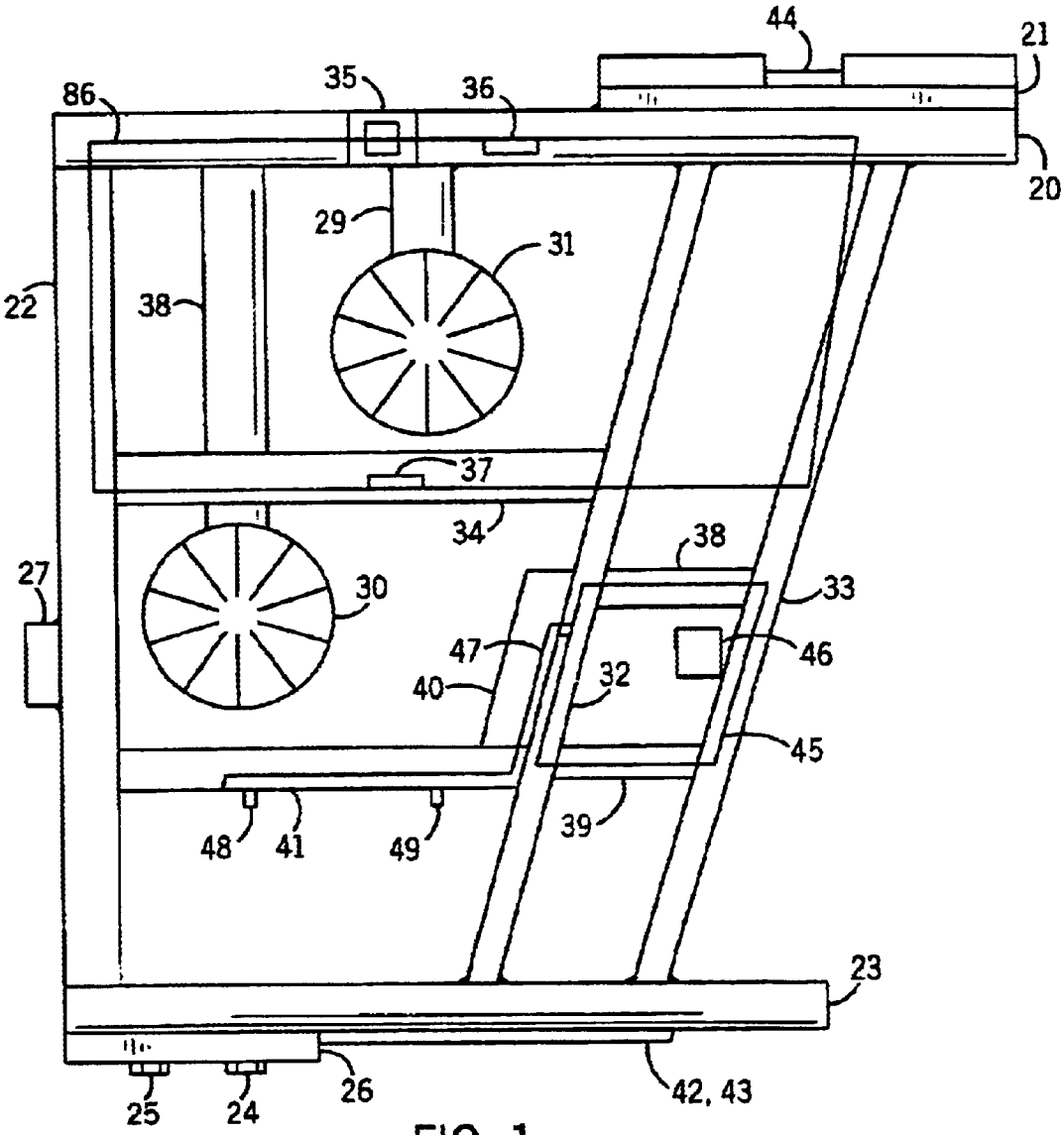
FIG. 1 is a top plan view of the curb brush and basic components.

Turning first to FIG. 1, the top view of the curb brush is illustrated. A 2"×6"×72"steel tubing 20 runs along the back of the implement. A universal backing plate 21 is welded to the steel tubing with 7 1¼"×6" pipes.

Figure 2:
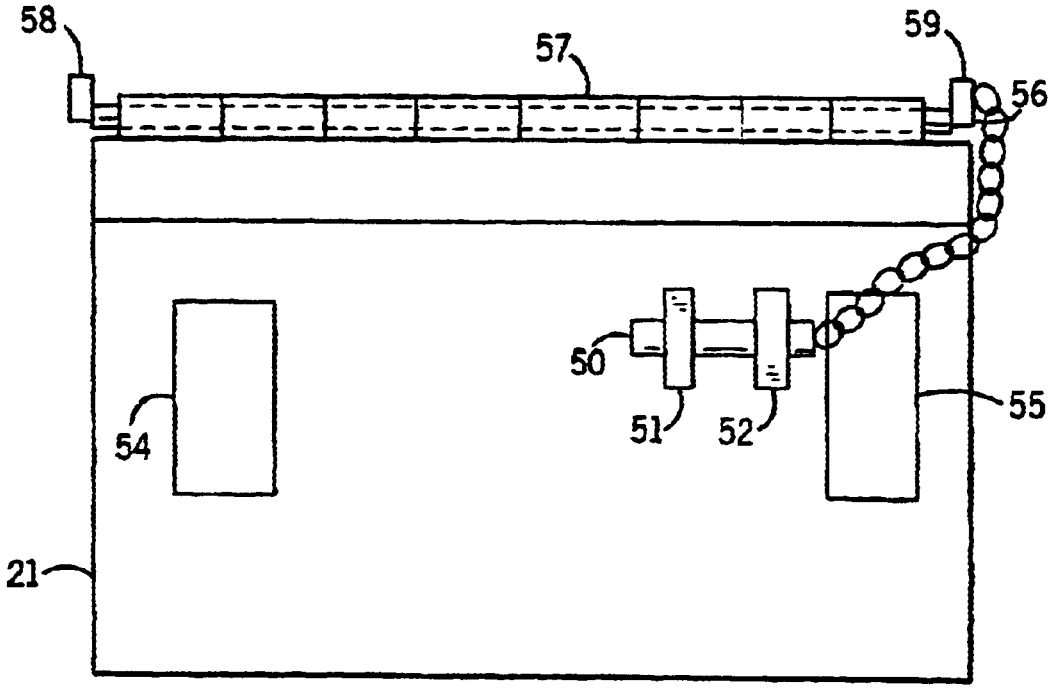
FIG. 2 is a front plan view of the universal backing plate and assembly.

Turning to FIG. 2, a frontal view of the connection is shown. A 1"×48" rod 56 runs through the pipes 57 to act as a hinge and is locked by 1" pencil rod 58, 59 welded to both ends of 56. The curb brush connection to the skid steer is made at the universal backing plate 21.

Figure 3:
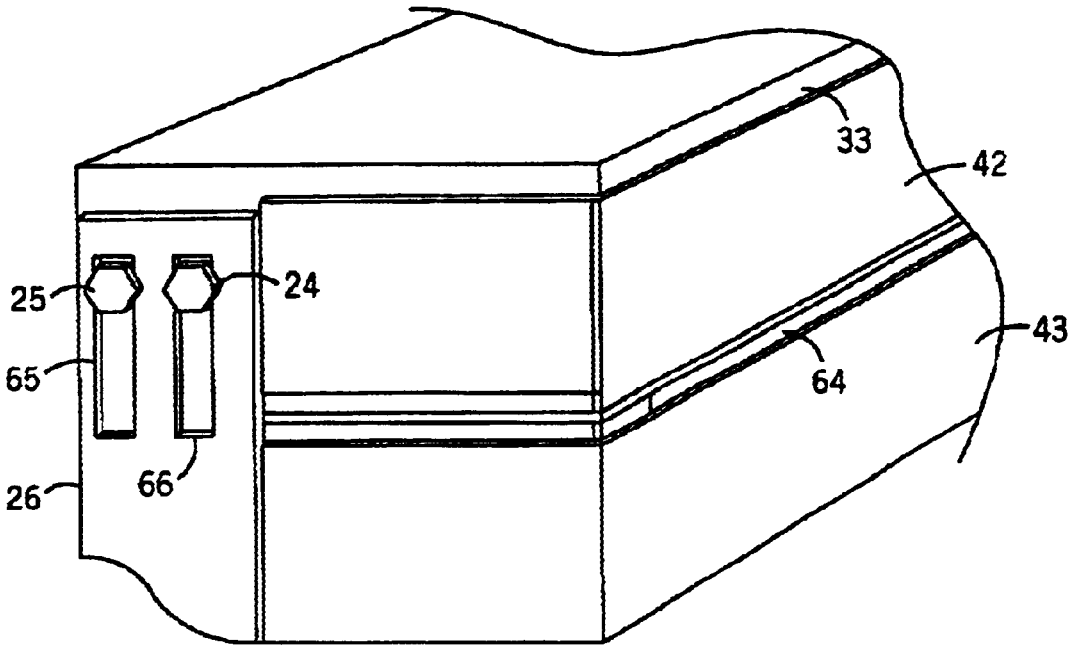
FIG. 3 is a perspective view of the steel scraper and assembly.

Returning to FIG. 1, a 2"×4"×38" steel tubing 22 is welded flush to the end of 20. A 2"×4"×38" steel tubing 23 is welded flush to 22. Two apertures are cut into 23 to allow two 1"×8" bolts 24, 25 to secure a steel scraper 26 to the implement. Turning to FIG. 3, this connection is shown in a frontal view. The steel scraper 26 is a 24"×30" piece of steel. The bottom is cut to form to rounded curbs. There are two 1⁄16" channels 65, 66 cut into the steel to allow 26 to raise and lower to a curbs height. Movement of the scraper is controlled by the two bolts 25, 24 locked through 65 and 66, respectively. 26 can be adjusted or removed easily by unlocking the nuts and removing 25 and 24.

Figure 4:
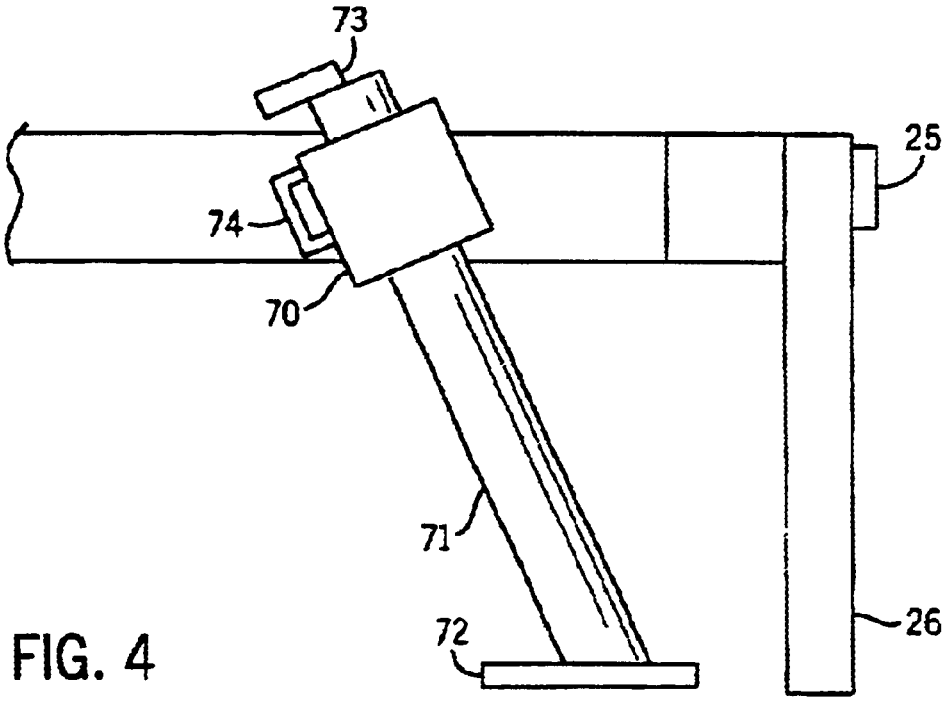
FIG. 4 is a side plane view of the locking leg and assembly.

Returning to FIG. 1, locking mechanism 27 is welded to 22. The locking system is used only when the implement is not working. Turning to FIG. 4, the mechanism is shown in a side view. A 2¼"×2¼"×7" steel tubing 70 is welded to the implement. A 2"×2"×30" steel tubing 71 runs through the steel tubing. At the base, a 3"×3"×¼" steel base 72 is welded to 71. 72 acts as a base when locked and a stop when loosened. At the top a 1"×1"×6" steel tubing 73 is welded to 71. 73 acts as a stop when the lock is loosened. Finally a handle 74 is locked to 70 with a ⅜" bolt. The handle can be loosened or tightened to 71. The curb brush cannot stand on its own so the leg supports it while loading, transporting and unloading. Once attached to a skid steer the leg can be loosened and raised off the ground during operation of the implement.

Returning to FIG. 1, a 2"×2"×15¼" steel tubing 29 is centered and welded flush to 20. A 2"×2"×34½" steel tubing 28 is centered between 29 and 22 and welded flush to 20. At the end of both of these gutter brooms 30, 31 are bolted. The gutter brooms can be removed easily by unlocking the nuts and removing the bolts. In a case of malfunction or breakage, the gutter brooms are easy to replace. Finally, 2'×2"×¼" steel angles 32, 33 are welded to 20 and 23.

Figure 7:
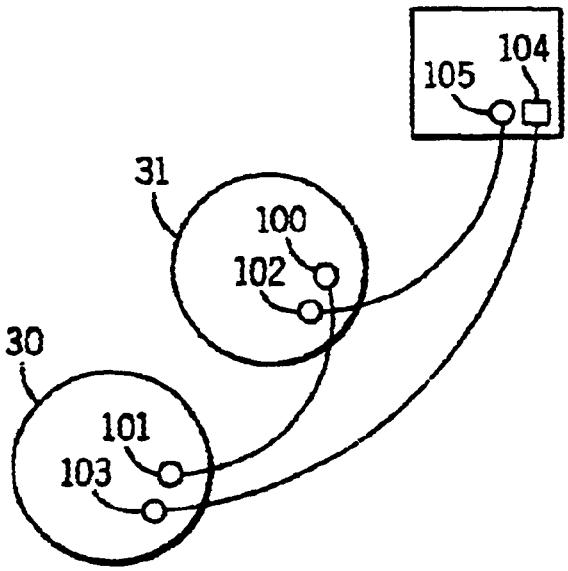
FIG. 7 is a top plan view of hydraulic connections.

In FIG. 7, hydraulic connections are shown. Gutter brooms have two connections for hydraulic hoses. A hydraulic hose is connected from rear adapter 100 and rear adapter 101. Another hydraulic hose is connected from front adapter 102 to the female connector 105 on the skid steer. A final hydraulic hose is connected from front adapter 103 to the male connector 104 on the skid steer. This powers the two gutter brooms.

At this point the implement is operational. From FIG. 1, a connection to a skid steer is made at the universal backing plate 21. The skid steer then can move the curb brush to curb side. The locking leg then can be loosened and lifted from the sweeping area. Hydraulic hoses connect to the gutter brooms and the skid steer to operate the motors that spin the gutter brooms. The implement can scrape large debris from curbs with the steel scraper 26. As large debris is displaced, gutter broom 30 displaces dirt from the top of the curb. Following 30, gutter broom 31 displaces dirt from the bottom of the curb. While operational the implement is not wholly safe nor extremely effective.

Turning to FIG. 3, safeguards are shown. Two rubber shields 42, 43 are mounted to the steel angles 33, 64. The rubber shield 42, attached to 33, is 13" wide and drapes over the bottom 12" rubber shield 43, attached to 64. The shields are secured to the steel angles with 3⁄16" self-drilling screws at every foot. The rubber shields run along the front and side of the implement. The rubber shields stop any loose or flying debris from escaping the curb brush. This lowers the risk to any passerby, vehicle, the environment or the operator. As well, the rubber shields contain the debris. In FIG. 1, another 12"×15" rubber shield 44 is attached at the gap of the universal and provides the same protection. All of these rubber shields can be removed by unscrewing the self-drilling screws.

Figure 5:
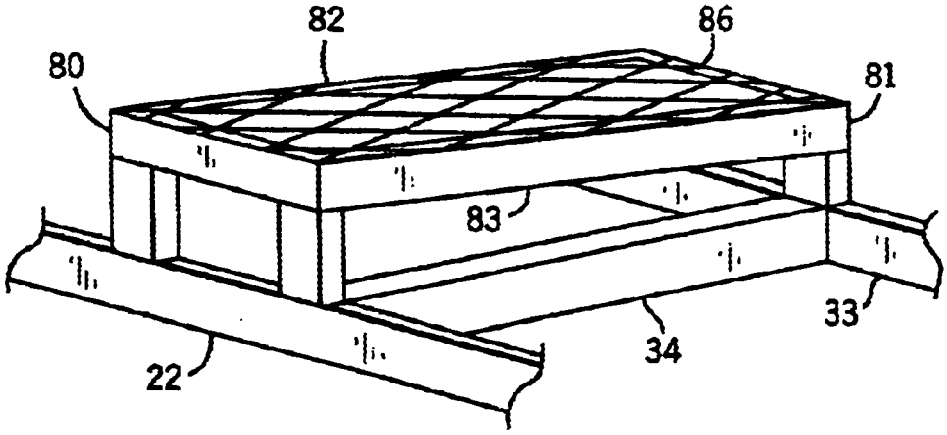
FIG. 5 is a perspective view of the carpenter's mesh shield and assembly.

Turning to FIG. 1, a 2"×2" steel tubing 34 is welded between the heads of the gutter brooms. Turning to FIG. 5, four 1½"×1½" angles are welded flush into a frame. Two 24½" pieces 80, 81 are welded flush to 48" steel angles 82 and 46" steel angle 83. This frame is welded to four 1"×1"×4" steel angles at each corner. This assembly is welded onto the curb brush frame 86 is welded 4" in on the back steel tubing length 22. 83 is welded to a 2"×2" steel tubing 33. A carpenter's mesh screen is attached to this frame using wire tires. This assembly diverts any dangerous airborne debris from harming any passerby, vehicle, the operator or the environment. As well, the mesh can easily be removed or replaced by cutting away the wire ties.

Returning to FIG. 1, safeguards for the hydraulic hoses are shown 35, 36, 37. A 3"×4"×8" steel tubing 35 is welded to 20. During loading, transport and unloading, the hydraulic hoses that run from both gutter brooms 30, 31 can be housed in 35. This prevents damage to the connections and the hoses themselves. Two pencil rod hoops 36, 37 are welded to 20 and 34 respectively. When in use, the hydraulic hoses are put through these hoops. This again protects any damage to the hoses brought on by the spinning gutter brooms or the street. Furthermore, it contains the hoses so operator has full visibility.

Returning to FIG. 2, a safety latch is shown. The safety latch is locked in with a 6" steel pin 50 on a chain that lock through two 2"×2"×8" steel plates 51, 52. This safety latch ensures safe loading, transport, and unloading. The pin keeps the universal backing plate 21 from moving when the implement is not in use. The pin locks through two apertures in 51 and 52. Once set in position the pin can be removed and the implement is safe for operation.

Still in FIG. 2, an added safety feature exists. Two C-channels 54, 55 are welded at each end of the universal backing plate 21. When the locking leg is lifted, greater stress is placed on the universal backing plate 21. 54 and 55 absorb some of this stress and prevent breakage of 21.

Figure 6:
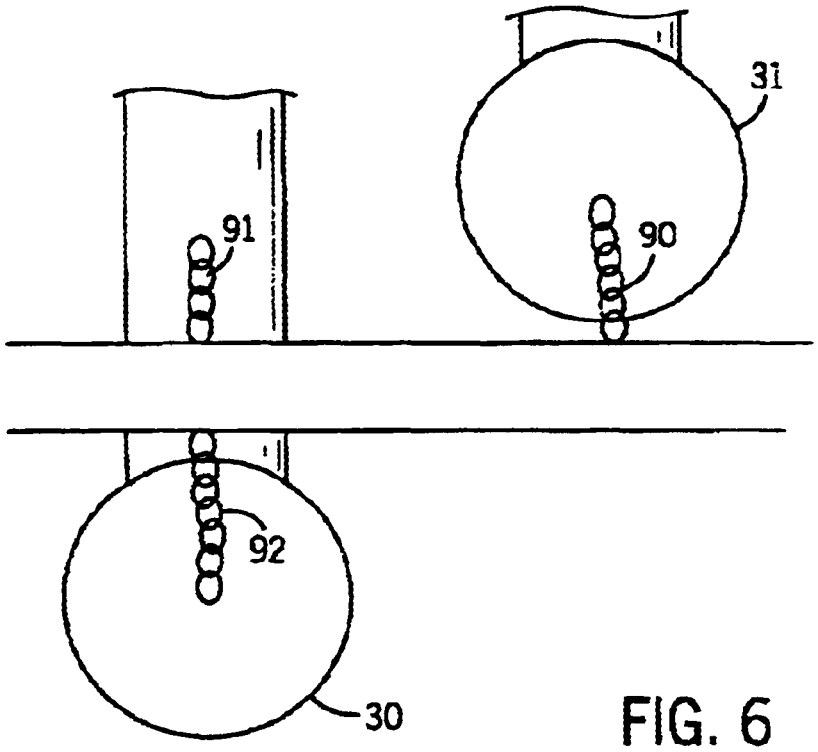
FIG. 6 is a top plan view of safety chains.

In FIG. 6, a top view of the gutter brooms is shown. Three steel chains 90, 91, 92 extend from 2"×2" steel tubing to the gutter brooms. 90 extends to the short armed gutter broom 31. 91 extends to the front of the long armed gutter broom 30. 92 extends to the middle of 30. The chains keep the gutter brooms from moving during use. 90, 91, 92 keep the gutter brooms on the proper track and reduce the stress on the steel tubing bolted to the gutter brooms.

In FIG. 1, two 1½"×1½" steel angle pieces 38, 39 are welded to 32 and 33. Upon 38 and 39 a water tank 45 is mounted. The water tank has a motor 46 that operates off of a 12 volt electric hook-up in the skid steer. The motor pumps water through a black water hose 47. The hose is contained within sections of 1" steel pipe welded to two 1½"×1+e,fra 12+ee " steel angles 40, 41. 40 and 41 are welded to the frame of the implement. In front of both gutter brooms a water nozzles 48, 49 are connected to hose. This allows water to be sprayed onto the curb in front of the two gutter brooms. Water dampens the dust, reducing the amount of airborne dust produced while cleaning curbs. This not only cleans the curb better, but also aids in the visibility and respiratory well being of the operator and the environment.

The complete implement combines all of the benefits of prior technology and combines it into an effective and safe tool for cleaning rounded curbs. The implement does not however clean flat streets. A preferred embodiment could offer a steel scraper cut to form to square curbs. The current intention and purpose of the invention is to displace debris from rounded curbs onto the edge.

What is claimed is:

1. A curb brush implement for displacing, removing and containing debris from the top and bottom of rounded curbs in a more thorough and safe manner, comprising:

a scraper cut to the shape of the curb to remove and contain large debris;

a first gutter broom mounted behind the scraper spinning counter clockwise to specifically displace debris from the bottom of the curb only onto the edge of the street;

a second gutter broom mounted behind the first gutter broom and offset from the curb to specifically displace debris from the bottom of the curb only onto the edge of the street;

a water tank with at least one nozzle mounted in front of each gutter broom to lower the amount of airborne dust; and at least one shield mounted in front and alongside the implement and a mesh shield above the gutter brooms to stop any loose or dangerous debris.

2. The curb brush implement for displacing debris from the top and bottom of rounded curbs as claimed in claim 1, wherein the scraper, gutter brooms, and a universal backing plate are welded to a steel tubing frame for use with a skid steer;

once attached to specific points to a steel tubing frame, the combination of the scraper and the two gutter brooms displace debris from the top and bottom of rounded curbs in a thorough and efficient manner;

furthermore, the addition of the universal backing plate enables the curb brush to operate within crowded or unfinished construction sites because it is able to be operated by a skid steer.

3. The curb brush implement for displacing debris from the top and bottom of rounded curbs as claimed in claim 1, wherein the water tank, the at least one shield and mesh shield protect the operator, passersby and environment by containing debris;

the water tank promotes visibility for the operator and efficiency of the curb brush by containing airborne dust;

the at least one shield promotes safety at the street side and efficiency of the curb brush by containing loose and flying debris from flying toward the center of the street.

4. The curb brush implement for displacing debris from the top and bottom of rounded curbs as claimed in claim 1, further comprising hose attachment members welded to secure hydraulic hoses to the implement;

once attached to the curb brush, the hoses are secured out of the operator's sight line.

5. The curb brush implement for displacing debris from the top and bottom of rounded curbs as claimed in claim 4, wherein said hose attachment members comprise pencil rod arcs.

6. The curb brush implement for displacing debris from the top and bottom of rounded curbs as claimed in claim 1, further comprising at least one chain to secure first and second gutter brooms from lateral and longitudinal movement during use to maintain thorough displacement of debris from rounded curbs.

7. The curb brush implement for displacing debris from the top and bottom of rounded curbs as claimed in claim 6, wherein there are chains to secure first and second gutter brooms from lateral and longitudinal movement.

8. The curb brush implement for displacing debris from the top and bottom of rounded curbs as claimed in claim 1, wherein the scraper is a steel scraper.

9. The curb brush implement for displacing debris from the top and bottom of rounded curbs as claimed in claim 1, wherein there are two water nozzles mounted in front of each gutter broom.

10. The curb brush implement for displacing debris from the top and bottom of rounded curbs as claimed in claim 1, wherein the at least one shield is a rubber shield.

11. The curb brush implement for displacing debris from the top and bottom of rounded curbs as claimed in claim 1, wherein the mesh shield is a carpenter's mesh shield.

12. The curb brush implement for displacing debris from the top and bottom of rounded curbs as claimed in claim 1, wherein there are rubber shields mounted in front and alongside of the implement.

* * * * *